US005537779A

United States Patent [19]

Jackson

[11] Patent Number: 5,537,779

[45] Date of Patent: Jul. 23, 1996

[54] STORM AND SECURITY PANELS

[76] Inventor: Duane W. Jackson, 946 Beachcomber La., Vero Beach, Fla. 32964

[21] Appl. No.: 289,582

[22] Filed: Aug. 15, 1994

[51] Int. Cl.[6] ..... E05B 65/04

[52] U.S. Cl. ..... 49/62; 49/463

[58] Field of Search ..... 49/61, 62, 463, 49/464; 52/202

[56] References Cited

U.S. PATENT DOCUMENTS

| | | | |
|---|---|---|---|
| 2,598,610 | 5/1952 | Satz et al. | 49/463 |
| 2,627,951 | 2/1953 | Mitchell | 49/62 |
| 3,290,823 | 12/1966 | Okumoto | 49/62 X |
| 3,421,259 | 1/1969 | Egan | 49/62 |
| 3,528,196 | 9/1970 | Luke | 49/62 |
| 3,831,319 | 8/1974 | Warner | 49/62 |

*Primary Examiner*—Jerry Redman
*Attorney, Agent, or Firm*—Law Offices of Royal W. Craig

[57] ABSTRACT

A protective storm and security panel arrangement for either awning or sliding type windows or sliding doors. The arrangement for an awning window includes a set of elongate panels, each one being fitted to cover a louver of the awning window. The panels are formed with one turned-in edge to provide a channel for slidable insertion over one end of a window louver, and a second edge having an offset lip that may be seated over the louver. The awning window is closed such that the respective louvers overlap and anchor adjacent panels in place to form a protective shield over the window. When modified for sliding windows, the invention includes a panel and an overhead bracket for mounting one edge of the panel on the sliding window. The panel is formed with two offset halves which conform to the sliding halves of the window when mounted on the bracket, and the bottom half is formed with a turned-in hooked edge to anchor said panel in place when said window is closed thereon. This panel may likewise be unitary or formed in discrete pieces. When modified for sliding doors, the invention includes a pair of interlocking panels which conform to the two sliding doors.

12 Claims, 14 Drawing Sheets

STORM AND SECURITY PANELS

FIELD OF THE INVENTION

This invention relates to the protection of windows, and more particularly, to add-on storm and security panels for the shielding of glass sliding and/or awning-type windows.

BACKGROUND OF THE INVENTION

Awning windows are a popular type of window commonly used on houses, porches, and many other structures requiring adjustable ventilation. Such windows employ a plurality of parallel horizontal window slats which may be angularly adjusted via a rotatable lever or knob. The slats may be adjusted from a fully open position to fully closed.

Existing awning type windows are highly susceptible to storm damage and forced entry due to their fragile elongate panes or slats. Conventional storm shutters offer one age-old solution. Storm shutters are typically nailed or otherwise affixed over the exterior of the closed window. Unfortunately, this is a laborious process and it renders the window temporarily inoperable.

There are more current forms of awning window protection, including demountable shields which are removably attached. For instance, U.S. Pat. No. 3,571,975 issued to Misiaszek discloses an add-on window protector for louvered windows. This particular design incorporates a plurality of angled slats into a unitary open-box frame. The slats fit between the overlapping louvers of the window, and when sandwiched between the louvers, the slats support the protective box-frame over the outside of the window.

Similarly, Shaw '148 discloses a shield and safety screen 10 which may be placed in the opening of a sliding window.

Unfortunately, the above-described and other prior art protective window panels are fairly expensive to make, they are difficult to install, and they hamper the normal operation of the window. For example, the Misiaszek '975 device is an intricate single-piece mold which must be installed from outside the window.

It would be greatly advantageous to provide a plurality of protective interlocking window panels which could be installed from inside a dwelling through the open slats of an awning window, and which interlock upon closure of the window to provide secure storm and/or security protection.

SUMMARY OF THE INVENTION

It is an object of the present invention to provide an improved storm and security panel for awning and sliding windows which gives sturdy protection, and which can be installed from inside or outside the home without any tools, thereby making installation possible from any level without scaffolding or the like.

It is a further object of this invention to provide a storm and security panel as described above which does not hamper the normal operation of the window when installed, and is lightweight and easy to store when removed.

It is still a further object of the present invention to provide a sturdy form of window protection which is aesthetically pleasing, and which conforms to the lines of the existing windows.

It is another object of the present invention to provide an easily installed window panel which can be transparent or black to alternately provide a view or blackout light from an interior room.

It is still another object of the invention to provide an interlocking pair of panels for securing conventional sliding doors.

In accordance with the above and other objects, the invention provides a protective storm and security arrangement for awning or sliding type windows and sliding doors.

The arrangement for an awning window includes a set of elongate panels, and each panel is fitted to cover a corresponding louver of the awning window.

Each panel is formed with a turned-in first edge providing a channel for slidable insertion over one end of a window louver, and a second edge having an offset lip defined by opposing right-angles.

The panels may be attached from inside by insertion through adjacent open louvers of the awning window. The panels are then retracted until the turned-in first edge catches an exterior end of a corresponding louver. The offset lip of the second edge of each panel is then seated over an interior end of the corresponding louver, and the window is closed such that the respective louvers overlay the offset lips of adjacent panels, thereby anchoring the panels in place to form a protective shield over the window.

Each above-described panel can be unitary, or formed from discrete components such as a main body section, a hooked first edge bracket attached on one side of said main body section for slidable insertion over an edge of a louver, and a flanged second edge bracket attached to the other side of said main body section and formed with an inward bend and opposing outward bend, thereby extending an offset flange outward from said main body section.

The invention may be modified for sliding windows, and in this respect includes a panel and an overhead bracket for mounting one edge of the panel on a sliding window. The panel includes a first main body section mountable along one edge to the bracket, and a coplanar second main body section attached at one edge to the other edge of said first main body section and offset therefrom. The opposing edge of the second main body section is turned-in to anchor said panel in place when said window is closed thereon.

Other advantages and results of the invention are apparent from the following detailed description by way of example of the invention and from the accompanying drawing.

BRIEF DESCRIPTION OF DRAWINGS

FIG. 8 is a perspective view showing a unitary storm and security panel.

FIG. 9 is a side view of the panel of FIG. 8 as it is installed on an open sliding window.

FIG. 10 is a side view of the panel of FIG. 8–9 fully installed and secured on a closed sliding window.

FIG. 11 is a side cross-section of a storm and security panel similar in function to that of FIGS. 8–10, but formed of discrete parts.

FIG. 12 is a perspective view of a pair of panels 400 and 410 for sliding doors. FIG. 13 is a close-up view of the panels 400 and 410 of FIG. 12.

FIG. 14 is a close-up view of panels 400 and 410 that is illustrative of their application to sliding doors.

DETAILED DESCRIPTION OF THE PREFERRED EMBODIMENT

Figure 1:
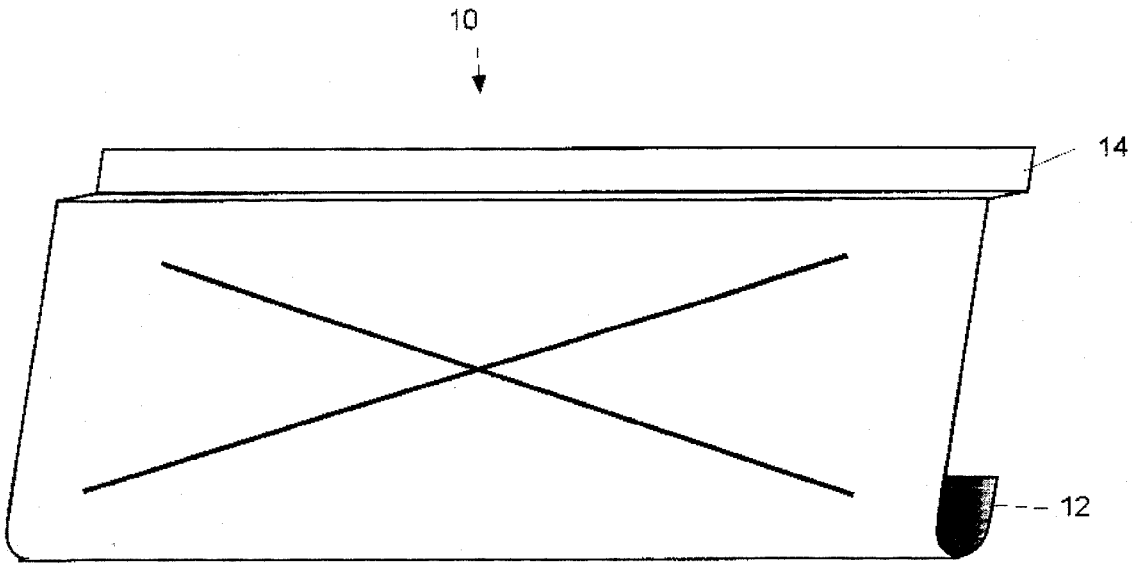
FIG. 1 is a perspective view of a single storm and security panel 10 for an awning window according to one embodiment of the present invention.
Figure 2:
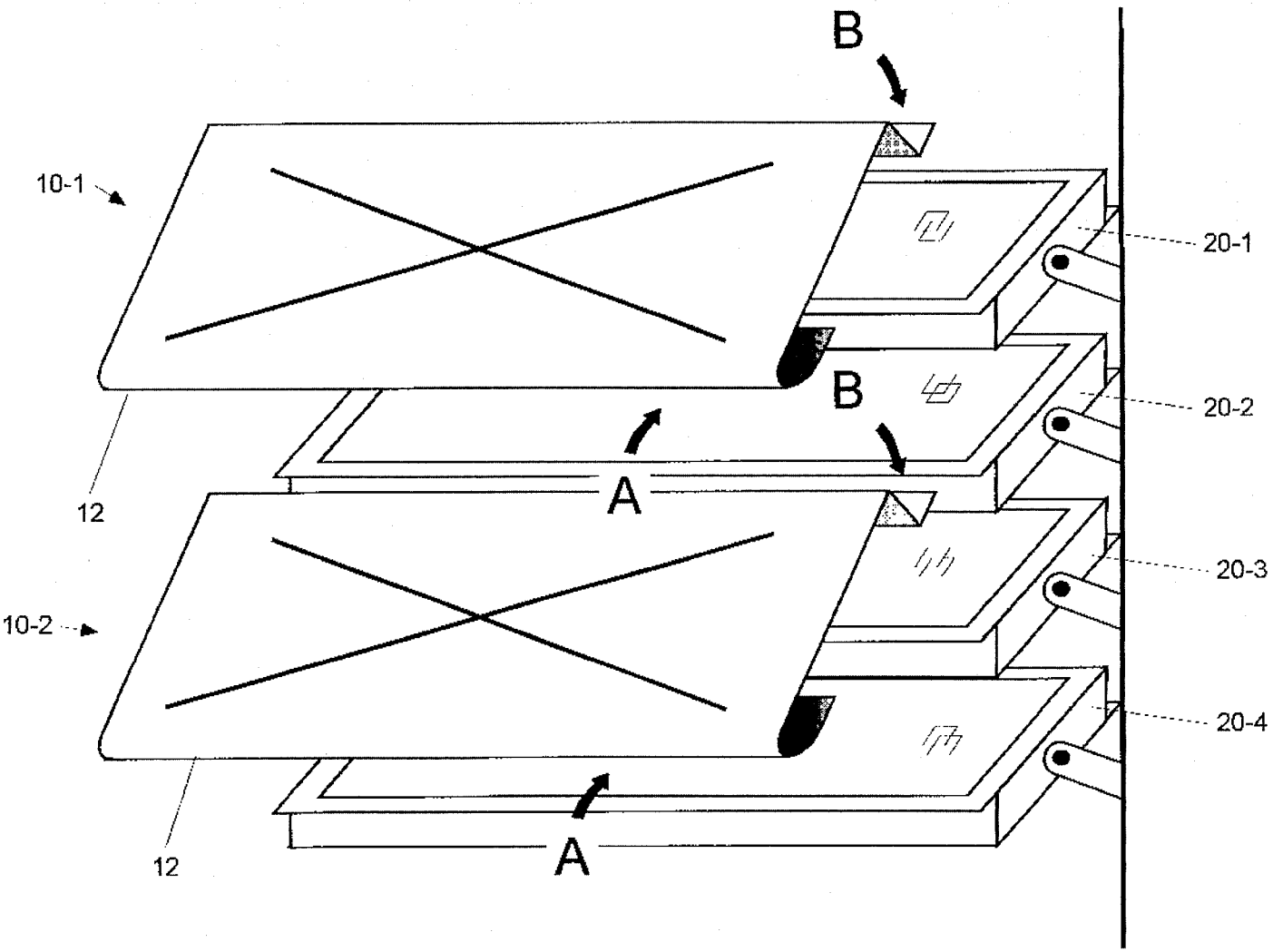
FIG. 2 shows a perspective view of a pair of storm and security panels as in FIG. 1 as they are installed onto a corresponding pair of window slats of a conventional awning-type window.

FIG. 1 is a perspective view of a single storm and security panel 10 for awning-type windows according to one embodiment of the present invention. The panel 10 is generally sized to conform to one individual louver (or slat) of a conventional awning-type window, i.e., the main body section is an elongate rectangle. One elongate edge 12 of the panel 10 is formed to hook inward upon itself, thereby forming a channel. The other elongate edge of the panel 10 is formed with an offset lip 14 defined by a right-angled first bend inward and a right-angled second bend outward. The offset lip 14 extends in parallel along the main body section of the panel 10. The main body section of the panel 10 may be slightly raised in a shallow pyramid (seen as an X) to reinforce the cross-section of the panel against storms, forced entry or other pressure. Alternatively, the main body section may be rippled FIG. 2 shows a perspective view of a pair of storm and security panels 10-1 and 10-2 as they are installed onto a corresponding pair of window louvers 20-1 and 20-3 of a conventional awning-type window. The arrows A and B indicate the sequence of attachment of panels 10-1 and 10-2 to the corresponding window louvers 20-1 and 20-2.

The storm and security panels 10-1,2 may be individually inserted from within the interior of the dwelling by pushing the hooked edge 12 outward between adjacent pairs of open louvers 20. Per arrows A, the storm and security panels 10-1 & 2 may then retracted such that the hooked edges 12 catch the outward corner of the corresponding louver 20-1 & 3, respectively. When the storm and security panels 10-1 & 2 have been fully retracted, the hooked edges 12 close over the outward corners of the corresponding louvers 20-1 & 3, respectively, and the panels 10-1 & 2 fall into place as the first bend of offset lips 14 clear the inner corners of the louvers 20-1 & 3.

Figure 3:
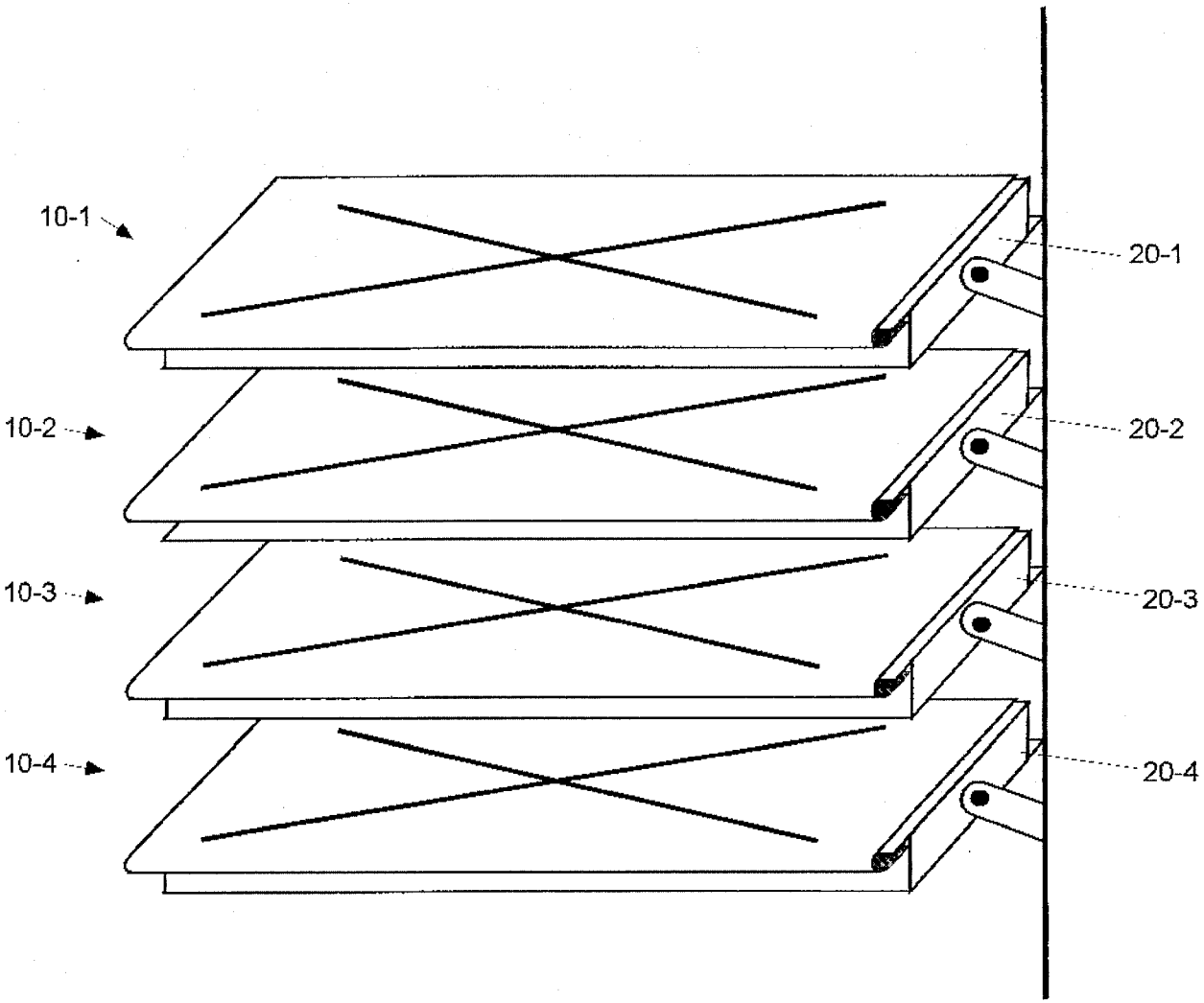
FIG. 3 is a perspective view of four fully installed storm and security panels as in FIG. 1.

FIG. 3 is a perspective view of four fully installed storm and security panels 10-1 . . . 4 on an open awning-type window.

Awning-type windows ares typically closed by an interior crank or other means, and the window louvers 20-1 . . . 4 draw upon themselves until they overlap each other in a substantially coplanar configuration. When fully closed with security panels 10 applied, the opposing edges of the security panels 10-1 . . . 4 overlap and interlock as more fully described below.

Figure 4:
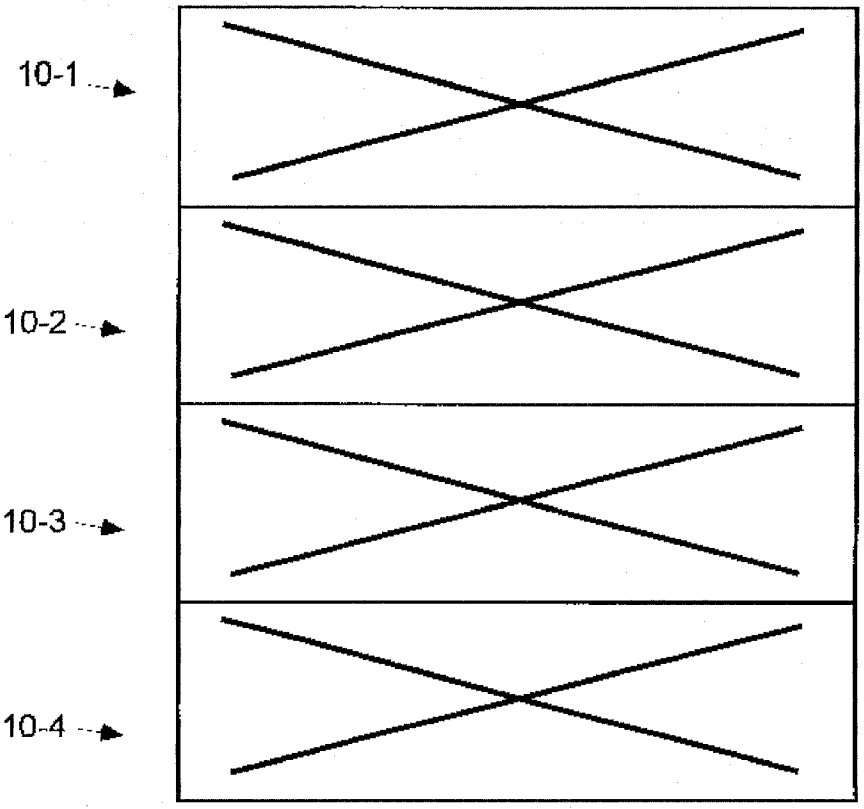
FIG. 4 illustrates the storm and security panels of FIG. 3 in a fully closed position.

FIG. 4 illustrates four storm and security panels 10-1 . . . 4 as in FIG. 3 in a fully closed position. It can be seen that the panels 10-1 . . . 4 interlock to form a unitary shield against the weather or any forced entry by intruders. In addition, the interlocking edges of panels 10-1 . . . 4 are completely recessed and inaccessible from the exterior. Consequently, the panels 10-1 . . . 4 are completely tamper-proof.

If desired, the panels 10-1 . . . 4 can be imprinted with various ornamental designs to give a more pleasing aesthetic appearance.

Figure 5:
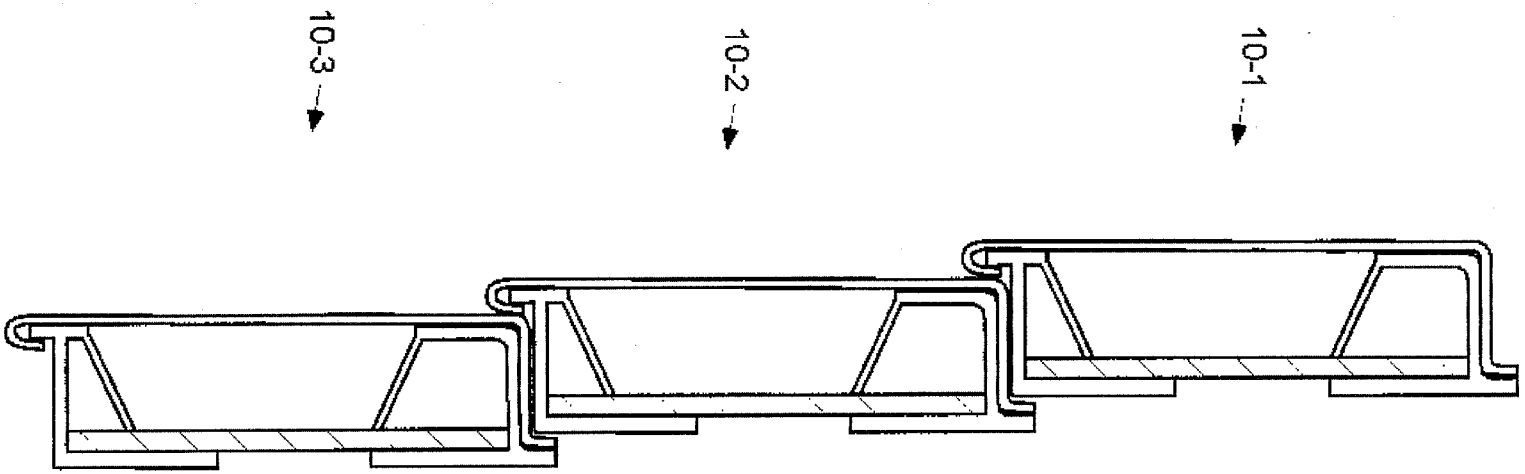
FIG. 5 is a side cross section of three exemplary interlocked storm and security panels covering three corresponding awning-type window slats.

FIG. 5 is a side cross-section of three exemplary interlocked panels 10-1 . . . 3 covering three corresponding awning-type window louvers 20-1 . . . 3. The window louvers 20-1 . . . 3 themselves each generally include an elongate glass pane 22 seated within a recessed rectangular frame 24. Struts 26 or other compressive devices maintain the pane 22 within the frame 24. The frames 24 have a flange 25 along one edge, and the panels 10-1 . . . 3 themselves interlock when fully closed by seating themselves against the flanges of adjacent louvers 20. The panels 101 . . . 3 each closely conform to the corresponding window louvers 20-1 . . . 3 and take full advantage of the interlocking overlap. More specifically, the offset lips 14 of each panel 10-1 . . . 3 closely conform to the flanges 25 of the corresponding louvers 20-1 . . . 3. Consequently, the louver 20-1 closes over the lip 14 of panel 10-2 and anchors it in place, and so on. The opposite edges 12 of louvers 10-1 . . . 3 remain hooked around the opposite edges of louvers 20-1 . . . 3.

The panels 10 can be formed of any durable and weatherproof material such as aluminum, stainless steel, plastic, vinyl, or the like. The particular shape of the panels 10 promotes convenient and cost effective manufacturing by blow molding, extrusion molding or pressing.

Figure 6:
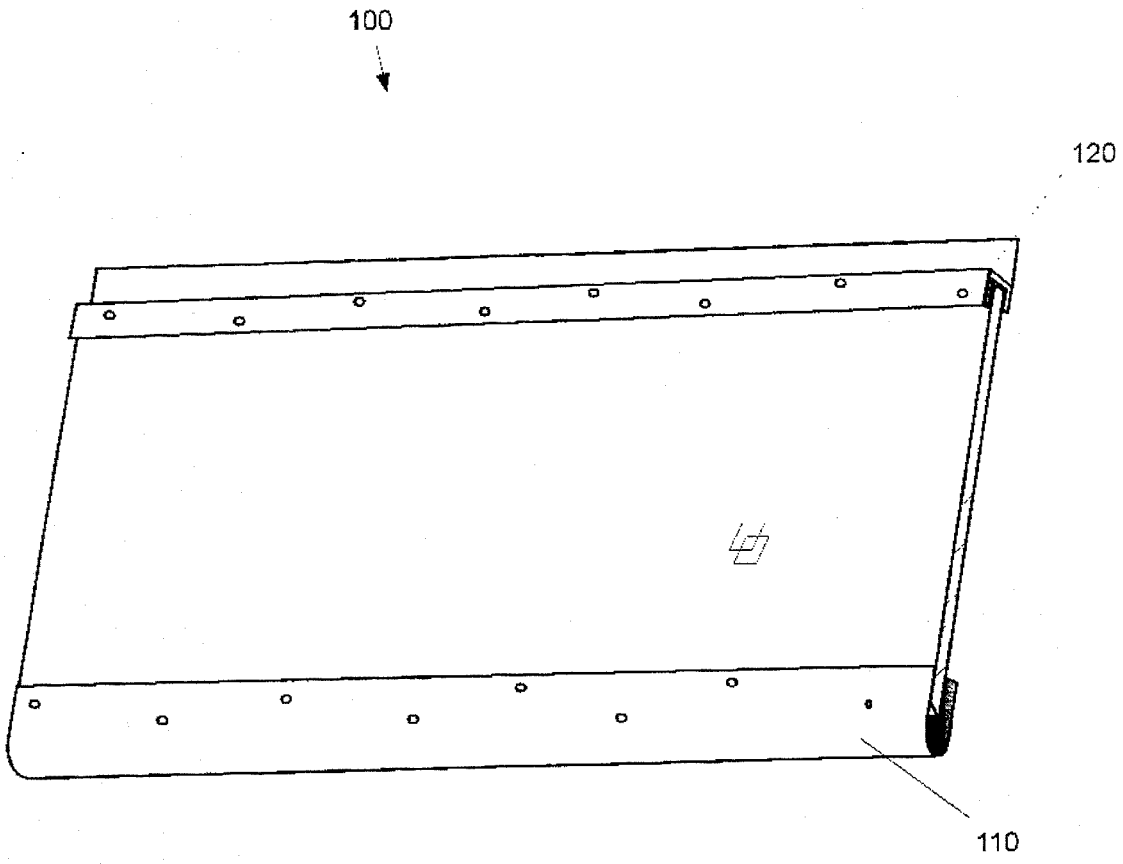
FIG. 6 is a perspective view of a storm and security panel 100 similar in function to that of FIGS. 1–5, but formed of discrete parts.

FIG. 6 is a perspective view of a modified storm and security panel 100 similar in function to that of FIGS. 1–5. However, the panel 100 of FIG. 6 is formed from discrete components. The main body section 102 of the panel 1 00 is a pane of sturdy transparent material to insure structural integrity, preferably Lexan®. The edges of the panel 100 are formed from metal brackets 110 and 120. For instance, 0.020" aluminum sheet may be used to form brackets 110 and 120, although any weatherproof, non-corrosive material may suffice.

Figure 7:
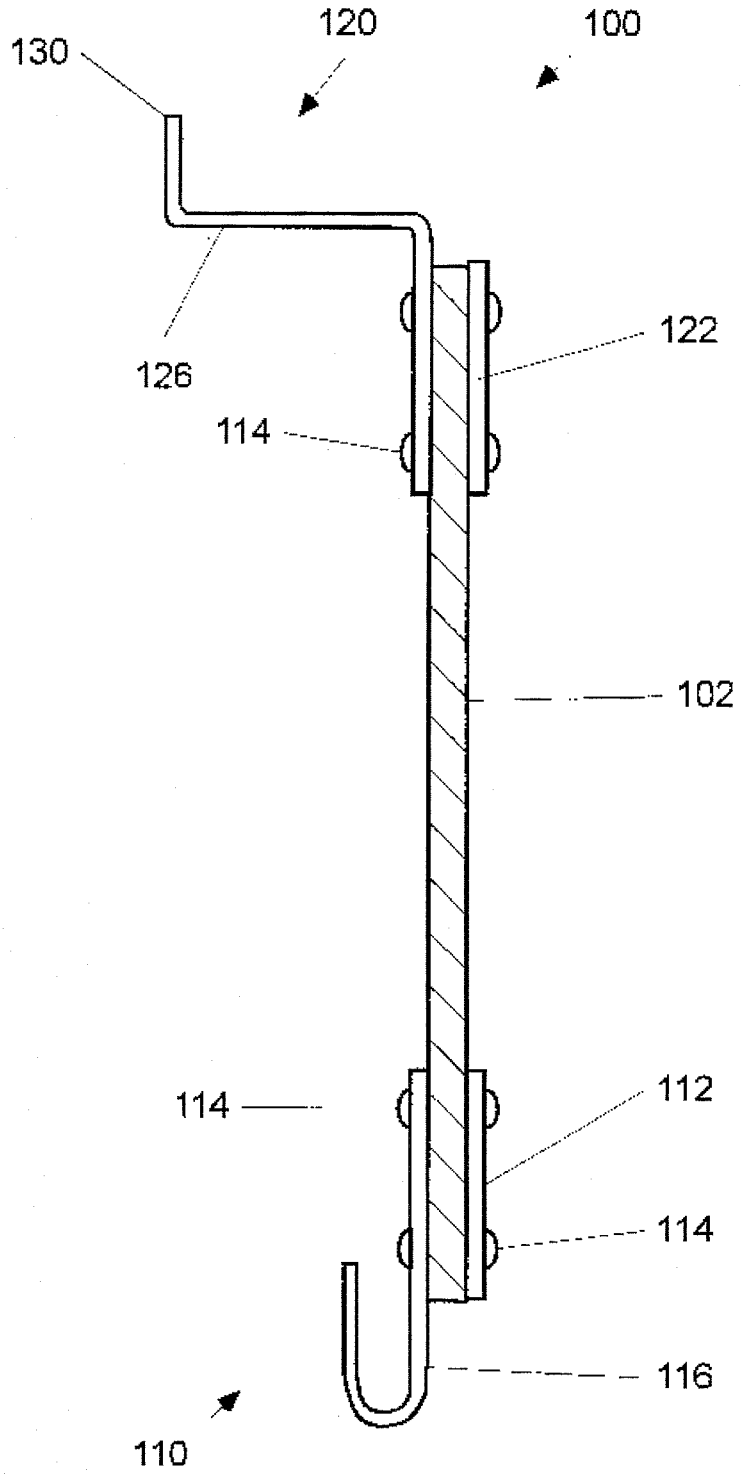
FIG. 7 is a side cross-section of the storm and security panel 100 of FIG. 6.

FIG. 7 is a side cross-section of the storm and security panel 100 of FIG. 6. The various components are rigidly attached together to again conform to one individual louver of a conventional awning-type window. The first edge bracket 110 includes an elongate rectangular reinforcement 112 that covers the outer edge of the pane 102. Rivets, heat stakes or other conventional anchors 114 penetrate the reinforcement 112 and pane 102 to attach a hooked cross-piece 116 to the underside of pane 102. As before, the hooked cross-piece 116 hooks inward upon itself.

A second edge bracket 120 also includes an elongate rectangular reinforcement 122 that covers an outer edge of the pane 102. Again, rivets, heat stakes or other conventional anchors 114 penetrate the reinforcement 122 and pane 102 to attach a flanged cross-piece 126 to the underside of pane 102. The flanged cross-piece 126 is formed with a right-angled first bend inward and a right-angled second bend outward, and thereby extends an offset lip 130 outward from pane 102. The lip 130 protrudes in parallel with the pane 102.

The installation and operation of panels 100 are the same as panels 10 of FIGS. 1–6.

FIGS. 8–11 illustrate two alternate embodiments of the storm and security panel of the present invention that are adapted for use with conventional sliding-type (or sash-type) windows.

Figure 8:
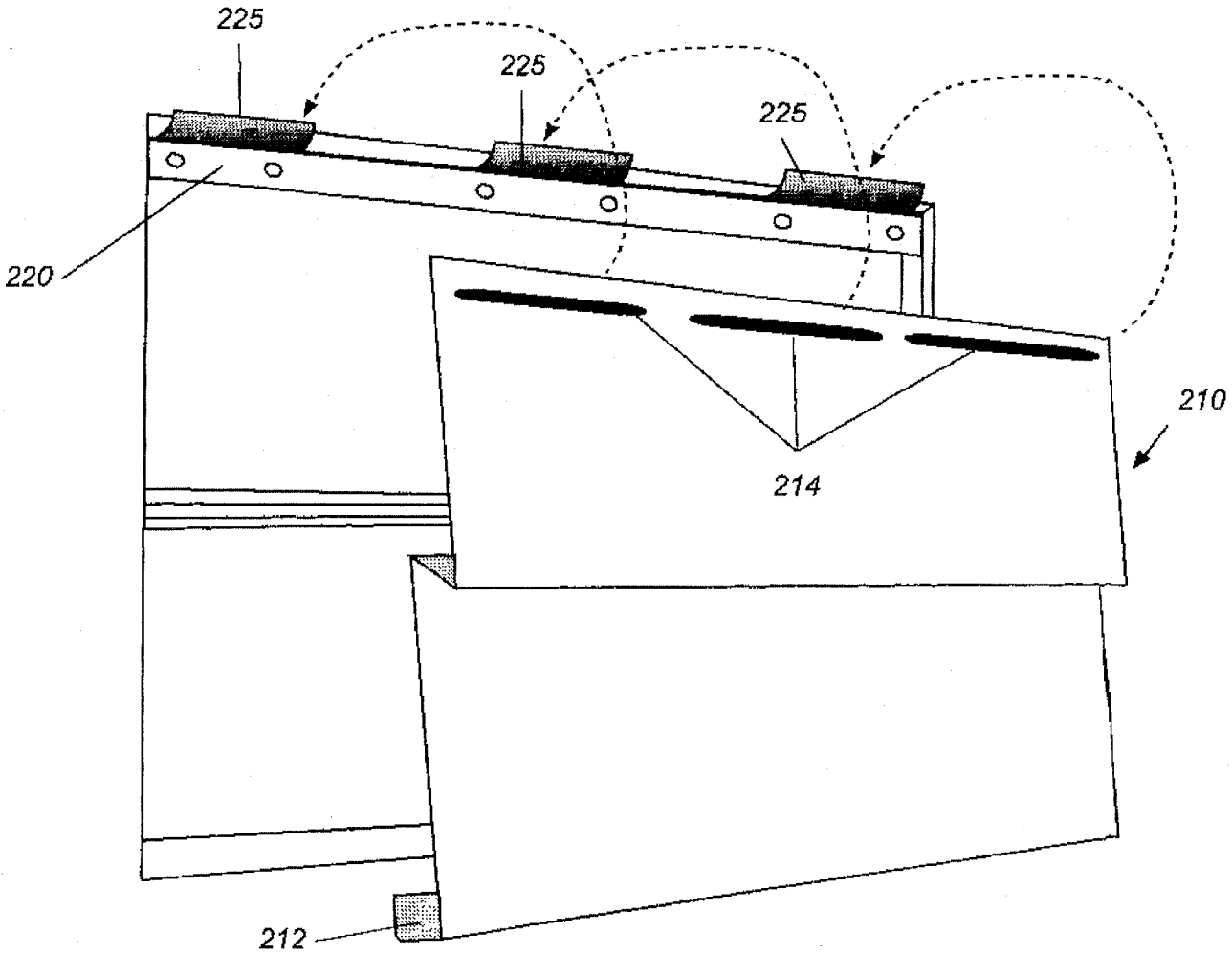
FIGS. 8–11 illustrate two alternate embodiments of the storm and security panel of the present invention that are adapted for use with conventional sliding-type (or sash-type) windows.

FIG. 8 is a perspective view of a unitary panel 210 which may be formed by molding, extruding, or pressing sheet steel, plastic, vinyl, aluminum or any other durable material.

The panel 210 is generally sized to conform to a pair of conventional sliding or sash-type window halves. Again, one elongate edge 212 of the panel 210 is formed to hook inward upon itself. The other elongate edge of the panel 10 is formed with a plurality of slots 214 aligned lengthwise.

The main portion of panel 210 is bisected by a right-angled first bend inward and a right-angled second bend outward to define two offset halves conforming to the halves of the window.

For installation, the panel 210 is attached to the sliding window by a mounting bracket 220 which must first be secured along the top of the upper window. The mounting bracket 220 is an elongate plate which may be riveted, nailed, screwed or otherwise anchored to the top of the window. Mounting bracket 220 is equipped with a plurality of tabs 225 extending angularly upward and outward, preferably at a 90° offset from vertical. The position of each tab 225 corresponds to one of the slots 214 in panel 210.

Figure 9:
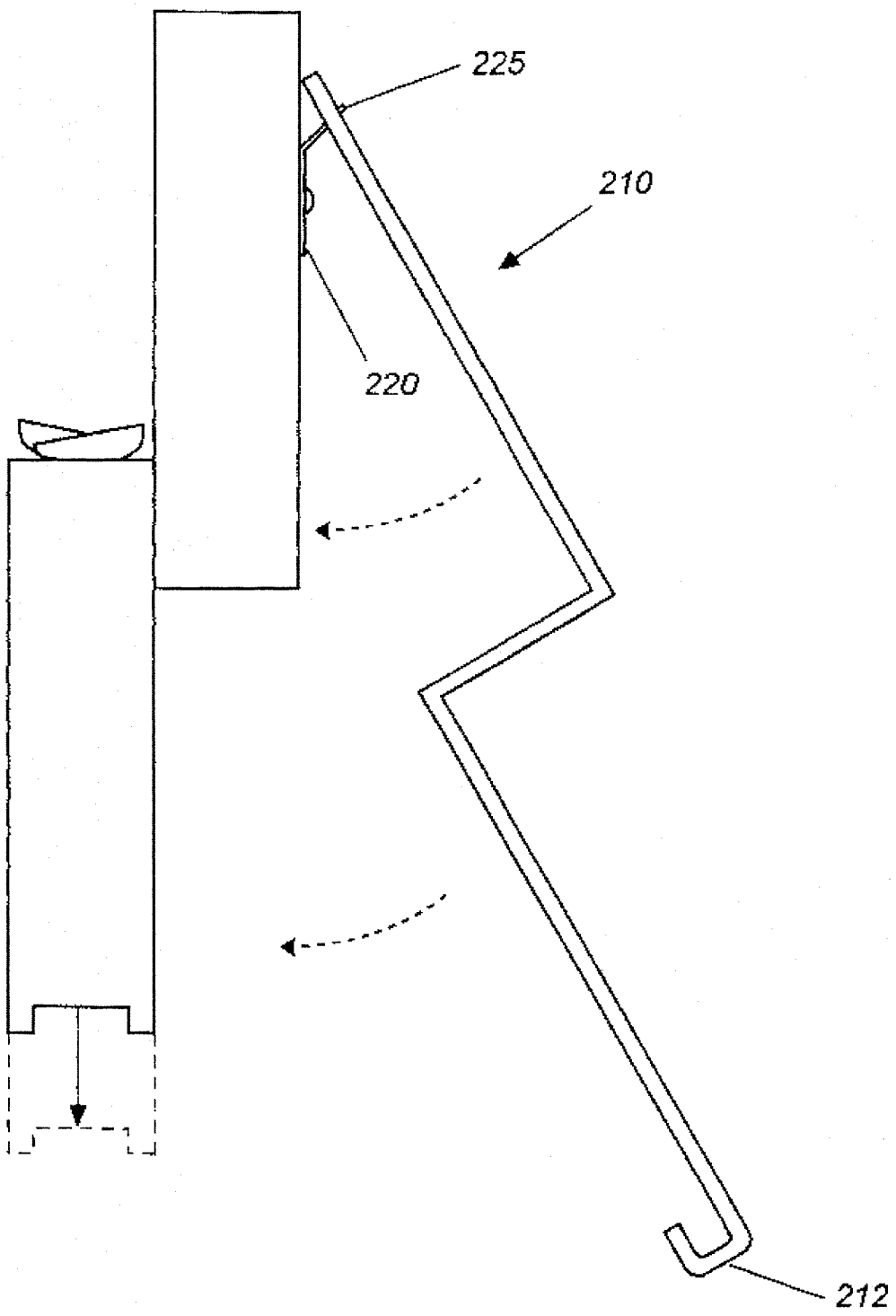

FIG. 9 is a side view of panel 210 as it is installed on an open sliding window. Panel 210 can be conveniently mounted at an angle on bracket 220 by fitting the slots 214 over the corresponding tabs 225. As indicated by the horizontal arrows, panel 210 is then pivoted downward into place until flush against the open window.

Figure 10:
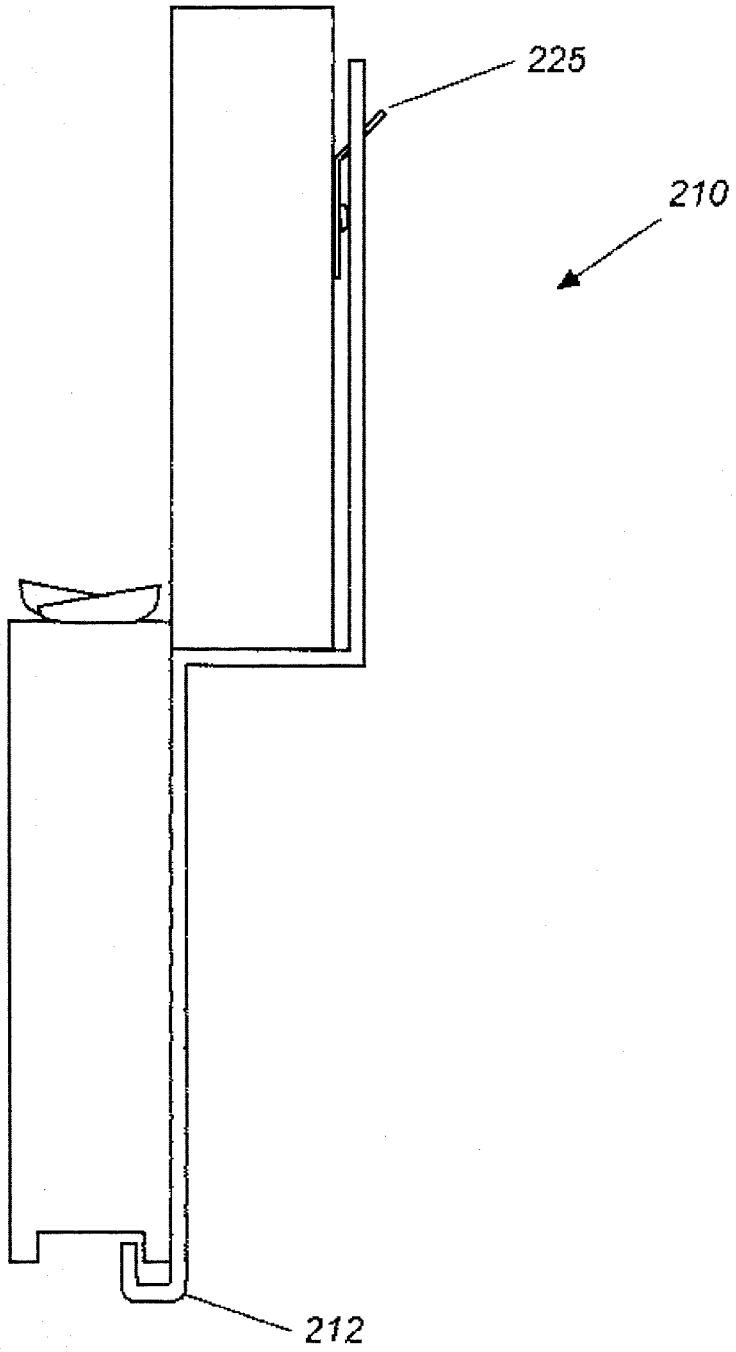

As shown in FIG. 10, the open bottom of the window is then slid downward into a fully closed position. Typically, the bottom half of the window is provided with a recess for an improved weather seal. The hooked edge of panel 210 is designed to hook into the recess. This way, when the bottom half of the window is closed onto the hooked edge 212, the panel 210 is securely anchored in place.

The existing interior window lock secures the panel 210 in position over the entire exterior face of the sliding window, and all vulnerable aspects of the window are eliminated. With the panel 210 in place a thief cannot break the glass to access the window lock. Since the panel 210 spans the recessed window pane, it acts with a reflex action to repel projectiles such as rocks and misguided birds. Moreover, the panel 210 is flush-fitting and unobtrusive.

Figure 11:
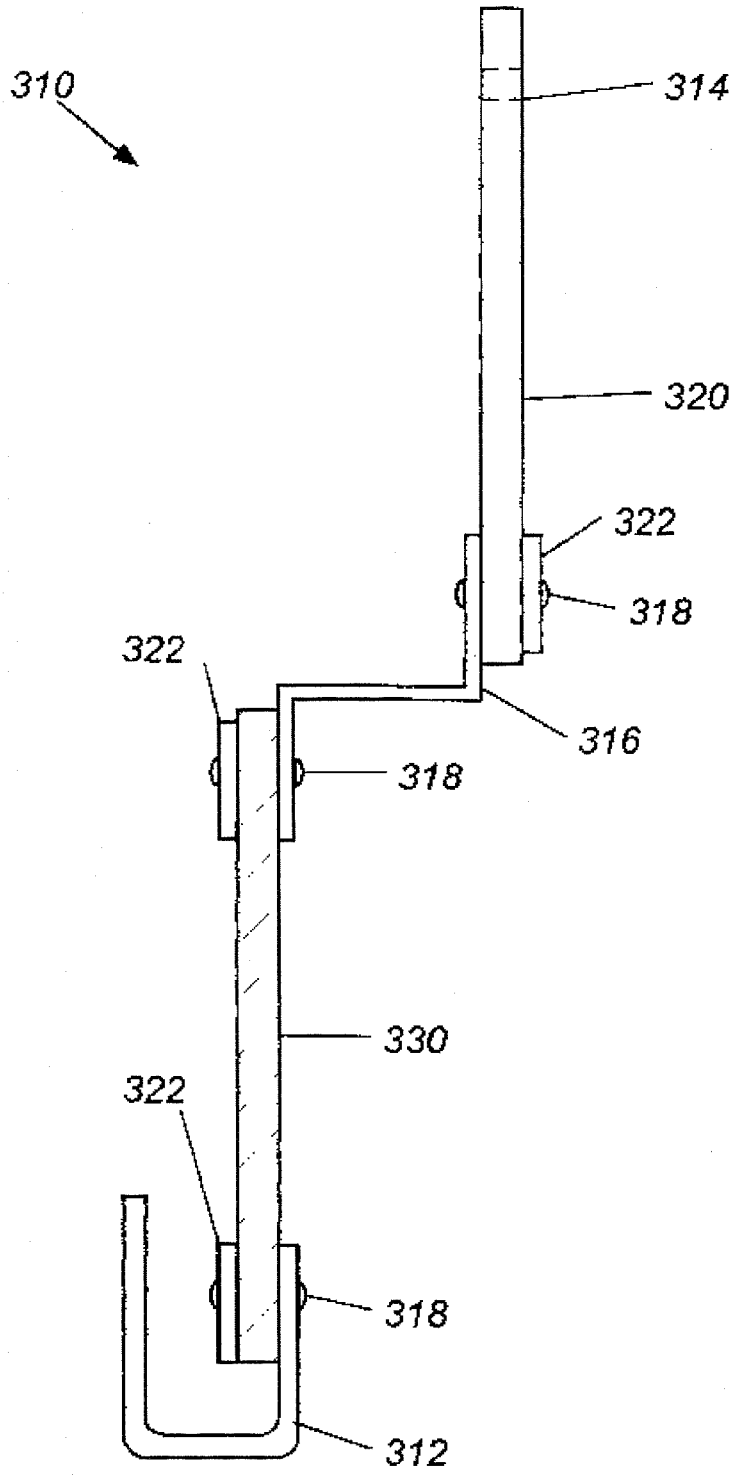

FIG. 11 is a perspective view of a modified storm and security panel 310 similar in function to that of FIGS. 8–10. However, the panel 310 of FIG. 11 is formed from discrete components. Specifically, the main body includes a rectangular first main body section 320 having an upper edge with a plurality of slots 31 4 spaced lengthwise, and a rectangular and substantially coplanar second main body section 330. The two main body sections 320 and 330 are joined along an edge by an elongate bridge cross-piece 316. The bridge cross-piece 31 6 is formed with an inward bend and opposing outward bend, thereby offsetting said first and second main body sections 320, 330. The bridge cross-piece 31 6 is attached by elongate reinforcements 322, and rivets, heat stakes or other conventional anchors 318 that penetrate the reinforcements 322 and respective panes 320 and 330.

A hooked cross-piece 312 is attached to the underside of pane 330 in the same manner using reinforcement 322 and rivets 318. As before, the hooked cross-piece 312 hooks inward upon itself to provide a channel to anchor the panel in place when the window is slid closed on it.

Main body sections 320 and 330 may be formed of any sturdy transparent material which insures structural integrity, preferably Lexan®. Again, 0.020" aluminum sheet may be used to form cross-pieces 312, 316 and 322, although any weatherproof, non-corrosive material may suffice.

Figure 12:
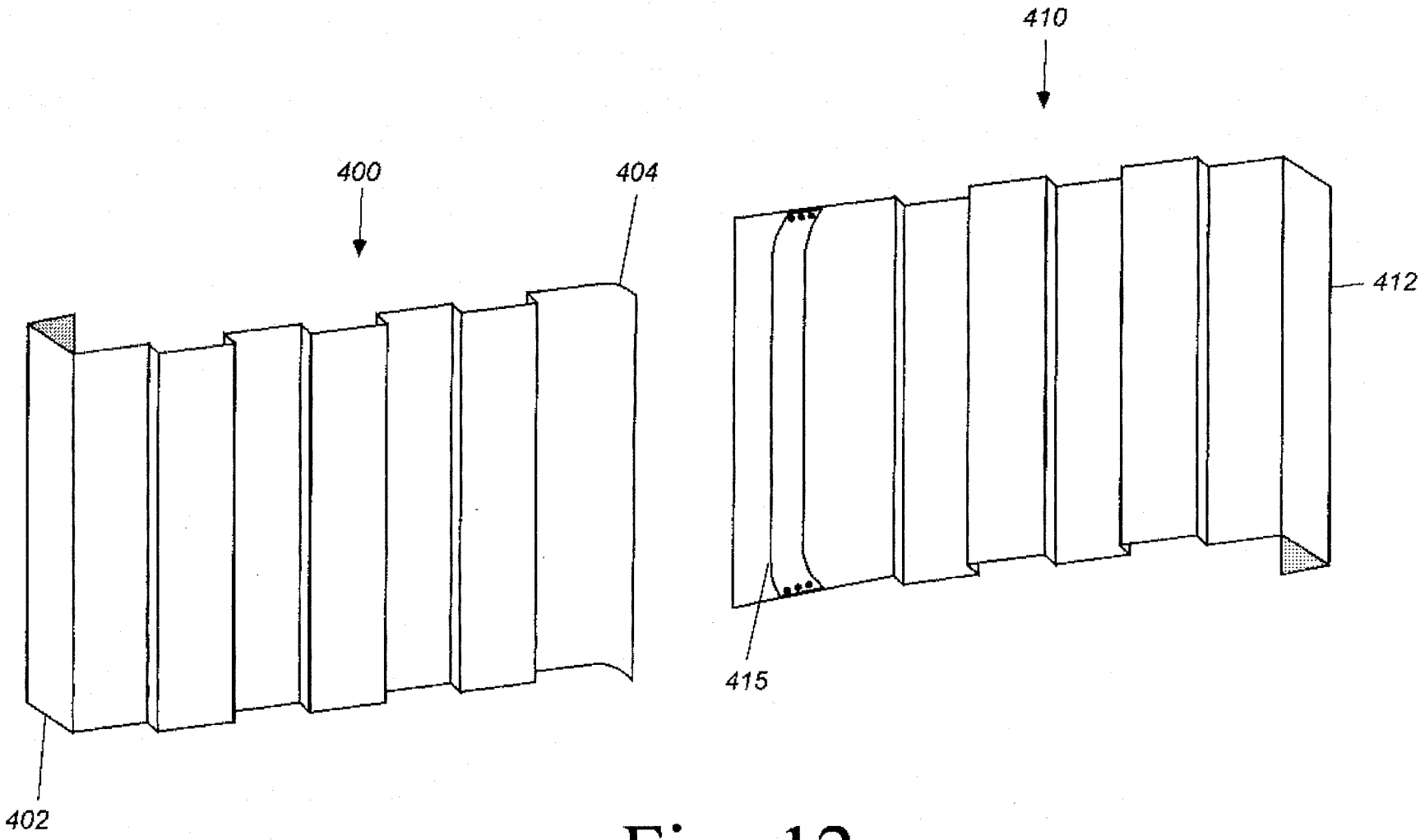
FIGS. 12–14 illustrate an alternate embodiment of the storm and security panels of the present invention that are adapted for use with conventional sliding doors.
Figure 13:
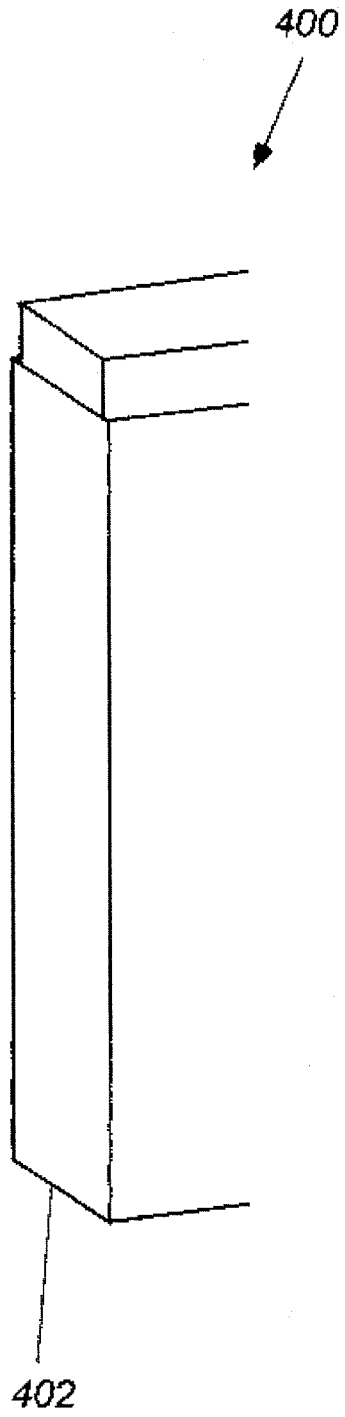
Figure 14:
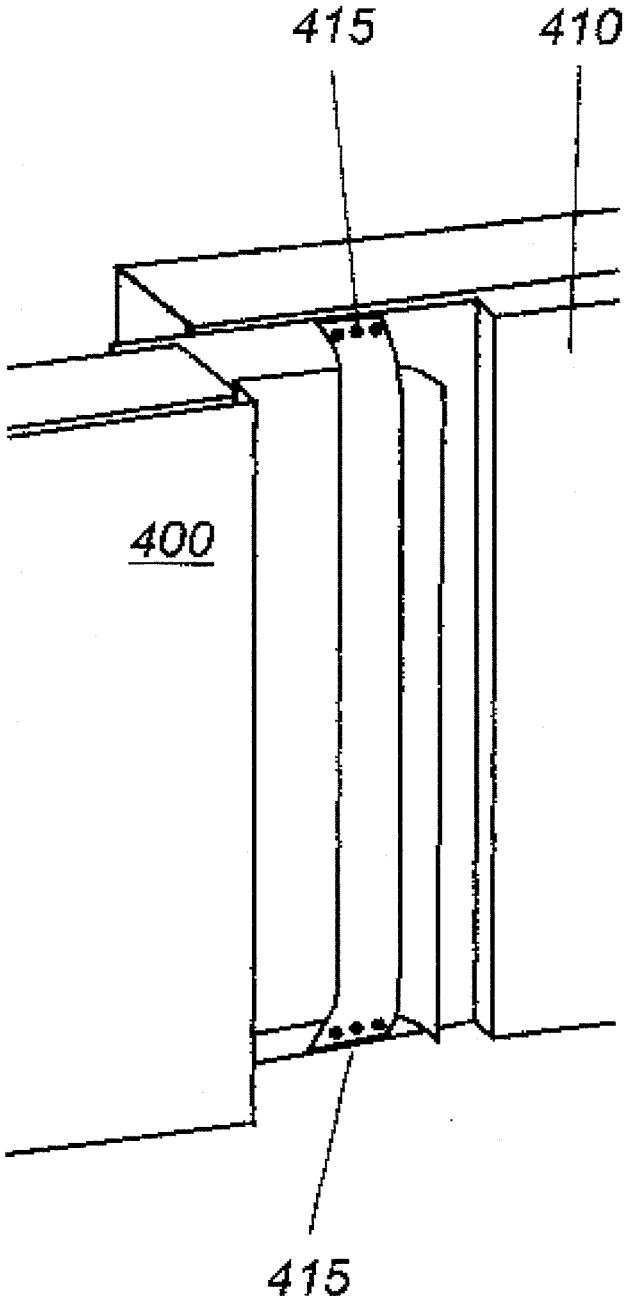

FIGS. 12–14 illustrate an alternate embodiment of the storm and security panels of the present invention that are adapted for use with conventional sliding doors.

FIG. 12 is a perspective view of a pair of panels 400 and 410 which again may be formed by molding, extruding, or pressing sheet steel, plastic, vinyl, aluminum or any other durable material. Each of panels 400 and 410 is generally sized to conform to one of an opposing set of conventional sliding doors. One elongate edge 402, 412 of each respective panel 400, 41 0 is formed to hook inward upon itself. FIG. 13 is a close-up view of exemplary edge 402 of panel 400. Both panels are formed with a plurality of reinforcing corrugations running vertically and spaced lengthwise.

Referring back to FIG. 12, the side of panel 410 opposite edge 412 is a substantially flat and extended lip, and a securing strap 415 spans the lip and is secured at the top and bottom. The side of panel 400 opposite edge 402 is likewise formed with a substantially flat and extended lip 404 that is designed to fit underneath the securing strap 415 of panel 410.

In application of the panels 400 and 410, while the leftmost sliding door is left partially open, the hooked edge 402 of panel 400 is first inserted around the leftmost sliding door as shown in FIG. 13. The leftmost sliding door is then closed.

As shown in FIG. 14, while panel 400 is held in place against the leftmost door, the flat right lip of panel 410 is inserted between the two sliding doors such that the securing strap 415 of panel 410 captures and holds the lip 404 of panel 400 in position. The rightmost sliding door is then partially open and the hooked edge 412 of panel 410 is inserted around the rightmost sliding door. The rightmost door is closed and the sliding doors are locked from within by the existing lock(s).

With the interlocking panels 400 and 410 in place a thief cannot break the glass to access the locks. The combined panels 400 and 410 span the recessed glass panes, it they act with a reflex action to repel projectiles and provide the same advantages as the above-described embodiments.

Having now fully set forth a detailed example and certain modifications incorporating the concept underlying the present invention, various other modifications will obviously occur to those skilled in the art upon becoming familiar with said underlying concept. It is to be understood, therefore, that within the scope of the appended claims, the invention may be practiced otherwise than as specifically set forth herein.

We claim:

1. A protective storm and security arrangement for an awning window, comprising:

a set of elongate panels, each panel being fitted to cover a louver in said awning window, and each panel being formed with a turned-in first edge providing a channel for slidable insertion over one end of said louver, and a second stepped edge defining an offset lip;

whereby said panels may be attached from inside said awning window by insertion through adjacent open louvers of said window, by slidably withdrawing said panels until the turned-in first edge catches an exterior end of said corresponding louver, by seating the offset lip of the second edge over an interior end of said louver, and by closing the window such that the respective louver become seated in the offset lips of adjacent panels, thereby anchoring panels in place to form a protective shield over said window.

2. The protective storm and security arrangement according to claim 1, wherein each of said panels is a unitary member.

3. The protective storm and security arrangement according to claim 2, wherein each of said panels is formed by extrusion molding.

4. The protective storm and security arrangement according to claim 3, wherein each of said panels is formed of aluminum.

5. The protective storm and security arrangement according to claim 2, wherein each of said panels is formed by pressing sheet metal.

6. The protective storm and security arrangement according to claim 5, wherein each of said panels is formed of galvanized steel.

7. The protective storm and security arrangement according to claim 1, wherein each of said panels further comprises, a main body section having a first edge and a second edge, a first edge bracket including an elongate reinforcement mounted along one side of said first edge, and a hooked crosspiece mounted along another side of said first edge and secured to said reinforcement through said main body section, a second edge bracket including an elongate reinforcement mounted along one side of said second edge, and a flanged crosspiece mounted along another side of said second edge and secured to said reinforcement through said main body section, said flanged crosspiece being formed with an inward bend and opposing outward bend, thereby extending an offset flange outward from said main body section.

8. The protective storm and security arrangement according to claim 7, wherein said main body section is transparent.

9. The protective storm and security arrangement according to claim 8, wherein said main body section is formed of one from among the group of plastic, vinyl, steel, and aluminum.

10. A protective storm and security panel fitted to cover a corresponding louver in an awning window, comprising:

a main body section;

a turned-in first edge providing a channel, for slidable insertion over one end of said louver, said turned-in first edge being provided by a first edge bracket including an elongate reinforcement mounted along one side of one edge of said main body section, and a hooked crosspiece mounted along another side of said one edge of said main body section and secured to said reinforcement through said main body section; and a second edge having an offset lip defined by opposing right-angles, the offset lip being formed by a second edge bracket including an elongate reinforcement mounted along one side of another edge of said main body section, and a flanged crosspiece mounted along another side of said edge and secured to said reinforcement through said main body section, said flanged crosspiece being formed with an inward and opposing outward bend, thereby extending said offset flange outward from said main body section;

whereby said panel maybe attached to said louver from inside the awning window by insertion between an adjacent open louver of said window, by retraction of said panel such that the turned-in first edge catches an exterior end of said louver, by seating the offset lip of the second edge over interior end of said louver, and by closing the louver to anchor the panel in place.

11. A protective storm and security panel fitted to cover a sliding window, comprising:

a bracket secured upwardly on said window and extending a plurality of tabs outwardly therefrom;

a rectangular first main body section having a first edge with a plurality of slots spaced therealong for cooperation with said tabs, and a second opposing edge;

a rectangular and coplanar second main body section having a first edge and a second opposing edge;

an elongate bridge cross-piece joining the second edge of said first main body section to the first edge of the second main body section, the bridge cross-piece being formed with an inward bend and opposing outward bend, thereby offsetting said first and second main body sections;

an elongate hooked cross-piece secured along the second edge of said second main body section, said hooked cross-piece turning in to provide a channel to anchor said panel in place when said window is closed thereon.

12. A protective storm and security device for securing a sliding door, comprising:

a first panel for conforming to one of a pair of sliding doors, said first panel having a hooked edge on one side to anchor said first panel in place when said one door is closed thereon, and a substantially flat edge on another side;

a second panel for conforming to a second of said sliding doors, said second panel having a hooked edge on one side to anchor said second panel in place when said second door is closed thereon, a substantially flat edge on another side, and a securing strap spanning said flat edge and fitted to capture the flat edge of said first panel therein.

* * * * *